US009799474B2

(12) United States Patent
Sakai et al.

(10) Patent No.: US 9,799,474 B2
(45) Date of Patent: Oct. 24, 2017

(54) CONTACTOR AND ELECTROMAGNETIC RELAY

(71) Applicant: Panasonic Intellectual Property Management Co., Ltd., Osaka (JP)

(72) Inventors: Satoshi Sakai, Mie (JP); Koji Yokoyama, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/088,298

(22) Filed: Apr. 1, 2016

(65) Prior Publication Data

US 2016/0300676 A1 Oct. 13, 2016

(30) Foreign Application Priority Data

Apr. 13, 2015 (JP) ..... 2015-081416

(51) Int. Cl.

| | |
|---|---|
| ***H01H 67/02*** | (2006.01) |
| ***H01H 50/02*** | (2006.01) |
| ***H01H 45/04*** | (2006.01) |
| ***H01H 50/20*** | (2006.01) |
| ***H01H 50/58*** | (2006.01) |
| ***H01H 47/22*** | (2006.01) |

(52) U.S. Cl.

CPC ..... *H01H 50/026* (2013.01); *H01H 45/04* (2013.01); *H01H 47/22* (2013.01); *H01H 50/20* (2013.01); *H01H 50/58* (2013.01)

(58) Field of Classification Search

CPC ..... H01H 50/20; H01H 50/045

USPC ..... 335/126, 131

See application file for complete search history.

(56) References Cited

U.S. PATENT DOCUMENTS

| | | | | |
|---|---|---|---|---|
| 4,983,940 | A * | 1/1991 | Konishi | H01H 50/14 335/126 |
| 5,892,194 | A * | 4/1999 | Uotome | H01H 1/34 218/68 |
| 5,990,771 | A | 11/1999 | Quentric | |
| 6,229,415 | B1 | 5/2001 | Quentric | |
| 6,229,416 | B1 * | 5/2001 | Ebihara | H01H 51/065 335/127 |
| 8,138,872 | B2 * | 3/2012 | Yoshihara | H01F 7/1615 335/124 |
| 8,222,980 | B2 * | 7/2012 | Yamagata | H01H 50/023 335/126 |

(Continued)

FOREIGN PATENT DOCUMENTS

| | | |
|---|---|---|
| JP | 10-308152 | 11/1998 |

*Primary Examiner* — Alexander Talpalatski

(74) *Attorney, Agent, or Firm* — Greenblum & Bernstein, P.L.C.

(57) ABSTRACT

A contactor includes a pair of fixed contacts, a movable contact element configured to contact the pair of fixed contacts and to be separated from the pair of fixed contacts, a movable shaft configured to move in an axial direction as to cause the movable contact element to contact the pair of fixed contacts and to be separated from the pair of fixed contacts, and a partition-wall component disposed opposite to the pair of fixed contacts with respect to the movable contact element. The first partition-wall component includes a partition wall provided around the movable shaft. The first partition wall is configured to move synchronously with at least one of the movable contact element and the movable shaft.

18 Claims, 13 Drawing Sheets

(56) References Cited

U.S. PATENT DOCUMENTS

| | | | | |
|---|---|---|---|---|
| 8,330,565 | B2 * | 12/2012 | Eum | H01H 51/065 335/126 |
| 8,674,796 | B2 * | 3/2014 | Ito | H01H 1/20 335/126 |
| 9,269,507 | B2 * | 2/2016 | Enomoto | H01H 50/546 |
| 9,496,109 | B2 * | 11/2016 | Lee | H01H 50/10 |
| 2009/0096559 | A1 * | 4/2009 | Yano | H01H 9/443 335/187 |
| 2013/0063232 | A1 * | 3/2013 | Takaya | H01H 9/443 335/201 |

* cited by examiner

CONTACTOR AND ELECTROMAGNETIC RELAY

TECHNICAL FIELD

The present invention relates to a contactor and an electromagnetic relay including the contactor.

BACKGROUND ART

A conventional electric contactor (an electromagnetic relay) including a movable contact contacting a fixed contact and being separated from the fixed contact is disclosed in, e.g. Japanese Patent Laid-Open Publication No. 10-308152. In the electric contactor disclosed in this document, a movable core (a movable core) causes a plunger (a movable shaft) to move in an axial direction as to cause the plunger to move a contact plate (a movable contact element) from a retracted position to an actuating position in the axial direction, thereby allowing the contact plate to contact a head (the fixed contact) of a terminal at the actuating position. The electric contactor disclosed in this document includes a lateral wall of a separation plate for reducing movement of foreign matter. The lateral wall described in this document is fixed on an inner side surface of a cover facing backward at the communication part between front and rear compartments of the cover.

SUMMARY

A contactor includes a pair of fixed contacts, a movable contact element configured to contact the pair of fixed contacts and to be separated from the pair of fixed contacts, a movable shaft configured to move in an axial direction as to cause the movable contact element to contact the pair of fixed contacts and to be separated from the pair of fixed contacts, and a partition-wall component disposed opposite to the pair of fixed contacts with respect to the movable contact element. The first partition-wall component includes a partition wall provided around the movable shaft. The first partition wall is configured to move synchronously with at least one of the movable contact element and the movable shaft.

DETAIL DESCRIPTION OF PREFERRED EMBODIMENTS

Exemplary Embodiment 1

Figure 1:
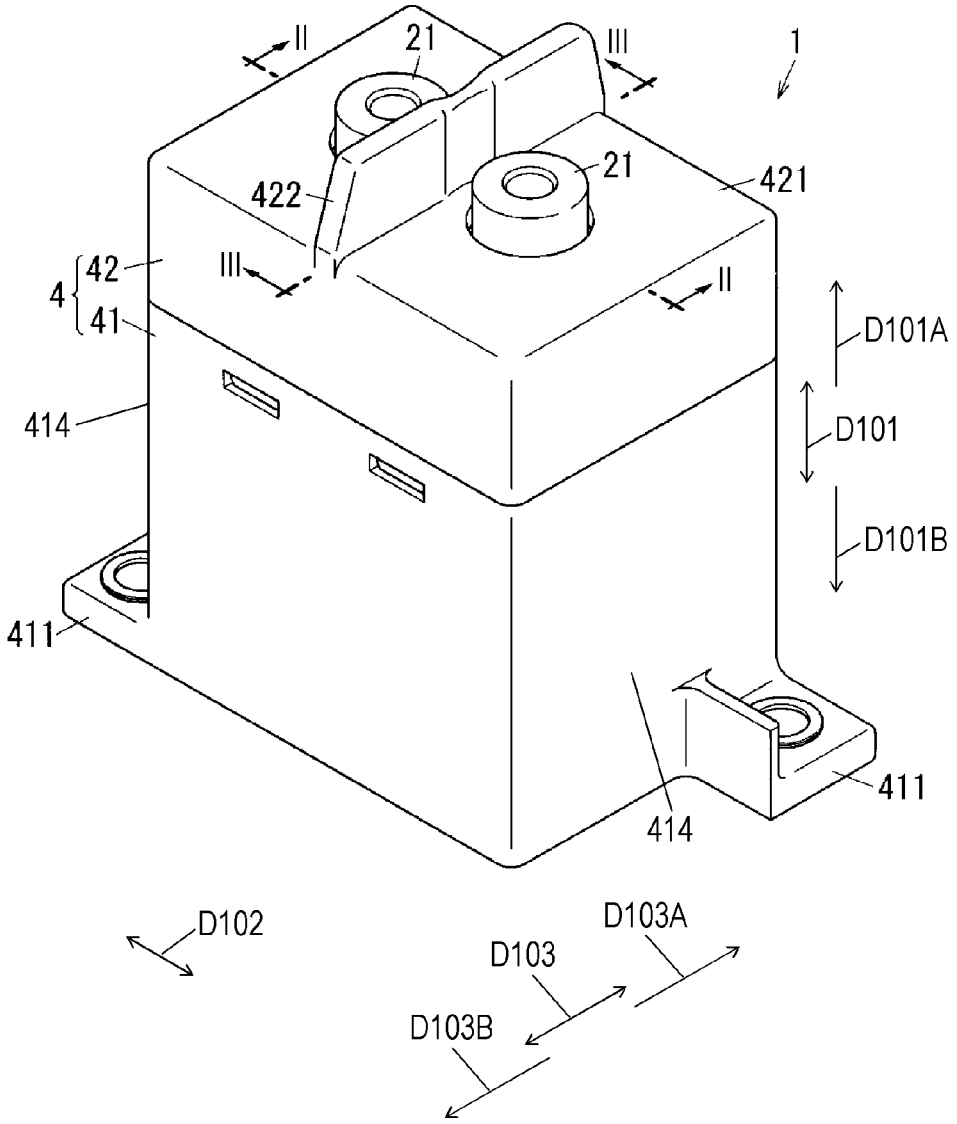
FIG. 1 is a perspective view of an electromagnetic relay according to Exemplary Embodiment 1.
Figure 2:
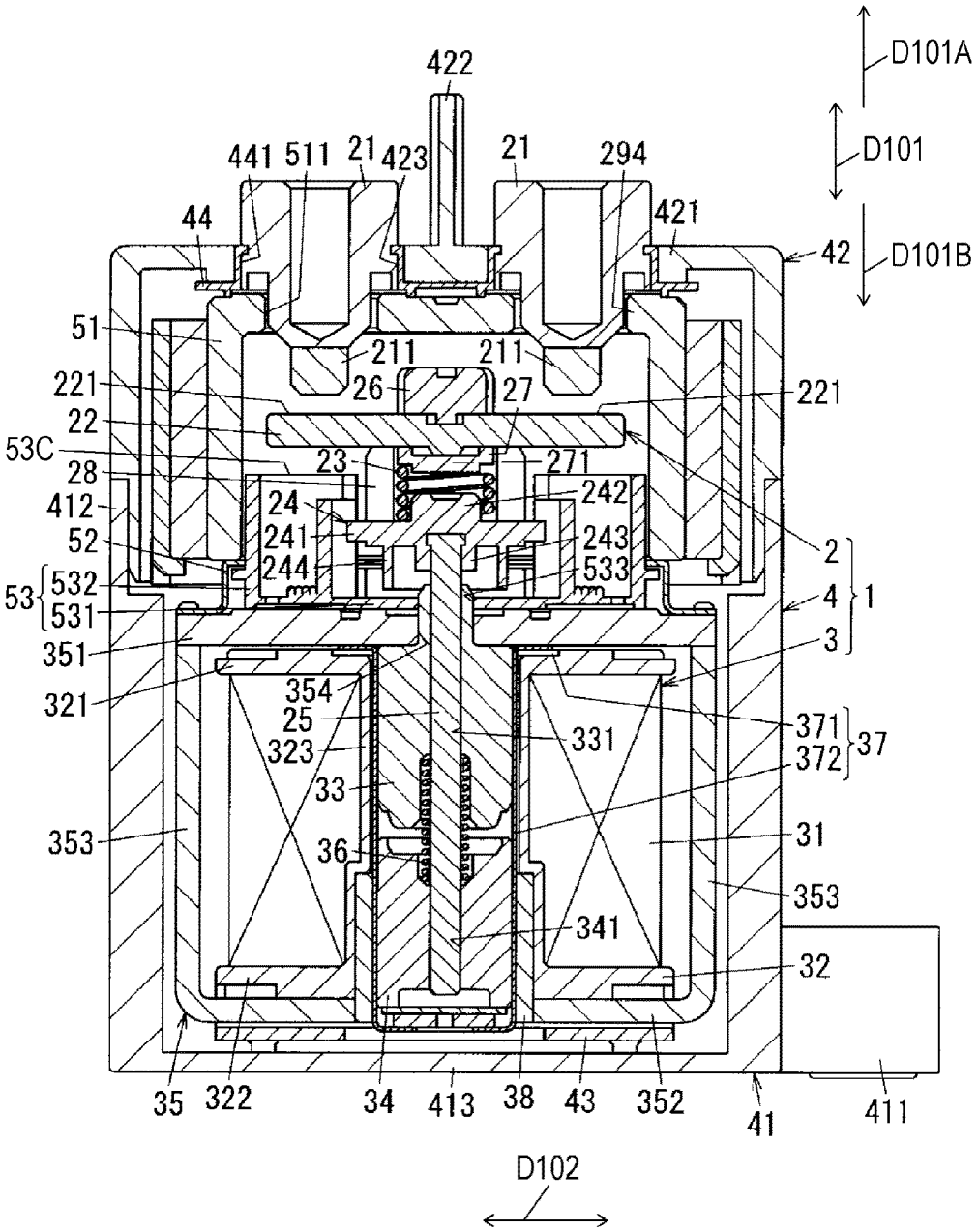
FIG. 2 is a sectional view of the electromagnetic relay on line II-II shown in FIG. 1.
Figure 3:
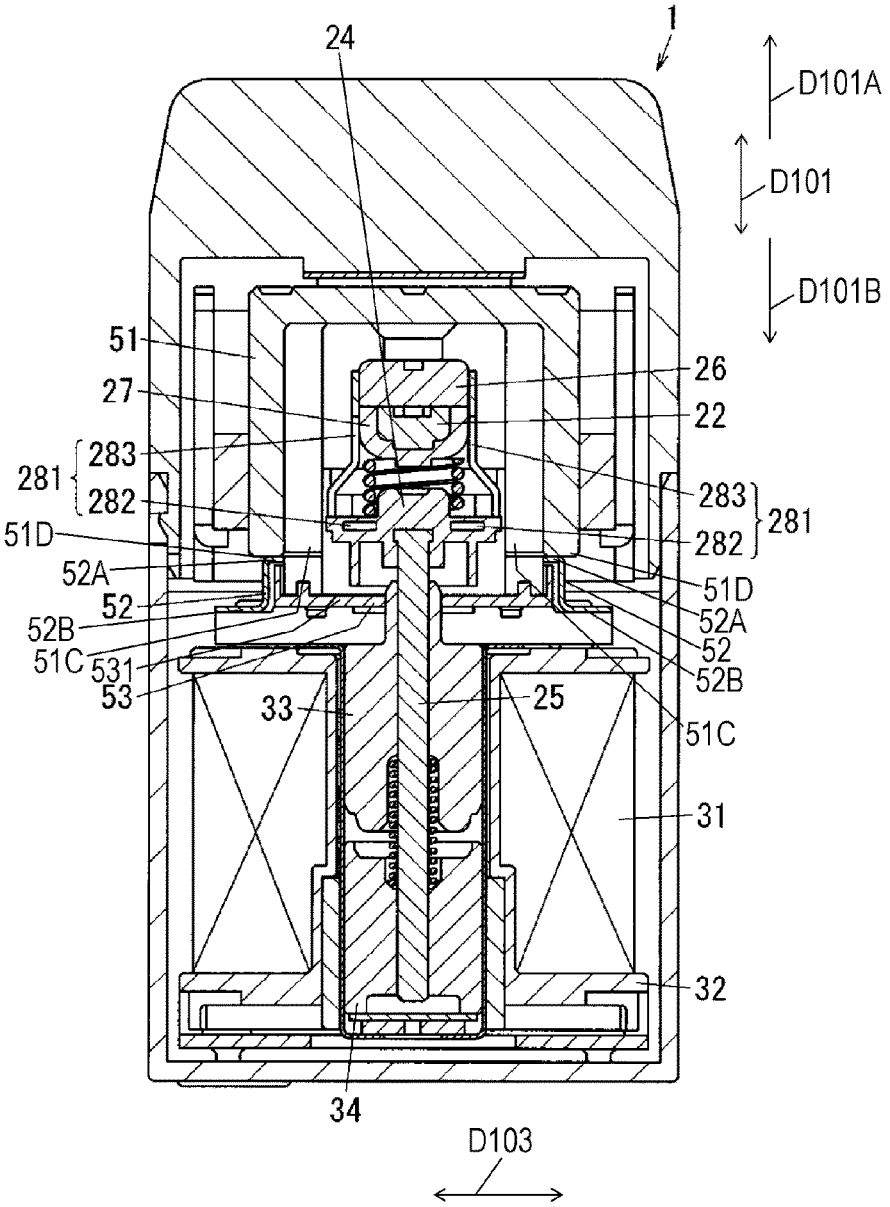
FIG. 3 is a sectional view of the electromagnetic relay on line III-III shown in FIG. 1.

FIG. 1 is a perspective view of electromagnetic relay 1 according to Exemplary Embodiment 1. FIG. 2 is a sectional view of electromagnetic relay 1 on line II-II shown in FIG. 1. FIG. 3 is a sectional view of electromagnetic relay 1 on line shown in FIG. 1.

As shown in FIG. 2, electromagnetic relay 1 according to Embodiment 1 includes contactor 2, driver 3, and housing 4 having a hollow box shape. Housing 4 accommodates contactor 2 and driver 3 therein.

Contactor 2 includes a pair of fixed terminals 21, movable contact element 22, press-contact spring 23, partition-wall component 24, movable shaft 25, adjuster 26, yoke 27, contact-element holder 28, case 51, connection body 52, and partition-wall component 53.

Each of fixed terminals 21 is made of conductive material, such as copper, and has substantially a circular columnar shape. Fixed contact 211 is provided at a lower end of fixed terminal 21. Fixed terminal 21 is inserted into aperture 511 of case 51. An upper end of fixed terminal 21 is brazed with case 51 while the upper end of fixed terminal 21 projecting from an upper surface of case 51.

The pair of fixed contacts 211 are fixed onto to lower ends of the pair of fixed terminals 21, respectively. Each fixed contact 211 may be formed unitarily with each fixed terminal 21.

Movable contact element 22 contacts the pair of fixed contacts 211 and is separated from the pair of fixed contacts 211. Movable contact element 22 has a flat plate shape extending slenderly in left and right directions D102. Each of a pair of movable contacts 221 is provided at respective one of two ends of an upper surface of movable contact element 22 in left and right directions D102. The pair of movable contacts 221 are two ends of movable contact element 22 in left and right directions D102. Each of the pair of movable contacts 221 faces respective one of the pair of fixed contacts 211 with a predetermined clearance between the contacts. Yoke 27 is engaged with a center part of movable contact element 22 in left and right directions D102.

Press-contact spring 23 is made of a coil spring that expands and contracts in upward and downward directions D101 perpendicular to left and right directions D102. Press-contact spring 23 is disposed between partition-wall component 24 and yoke 27. Positioning projection 271 of yoke 27 is inserted into an internal hollow of press-contact spring 23 from an upper end of press-contact spring 23 to position press-contact spring 23 with respect to yoke 27 and movable contact element 22.

Partition-wall component 24 is made of electrically insulative material, such as resin, and has substantially a rectangular plate shape. Partition-wall component 24 includes base 241 and positioning projection 242 having substantially a disk shaped, and is provided substantially at a center of an upper surface of base 241. Positioning projection 242 of partition-wall component 24 is inserted into the internal hollow of press-contact spring 23 from a lower end of press-contact spring 23 to position partition-wall component 24 with respect to press-contact spring 23.

Movable shaft 25 moves in axial direction D101 (upward and downward directions D101) as to cause movable contact element 22 to contact the pair of fixed contacts 211 and to be separated from the pair of fixed contacts 211. Movable shaft 25 has substantially a round bar shape extending slenderly in upward and downward directions D101 (axial direction D101). Movable core 34 of driver 3 is connected to a lower end of movable shaft 25. An upper end of movable shaft 25 is connected to partition-wall component 24. Movable shaft 25 is fixed to movable core 34 while movable shaft 25 is inserted into aperture 331 of fixed core 33, restoring spring 36, and aperture 341 of movable core 34.

Partition-wall component 53 faces partition-wall component 24 in axial direction D101 (upward and downward directions D101) of movable shaft 25.

Adjuster 26 is made of magnetic material and has, e.g. substantially a rectangular plate shape. Adjuster 26 is mounted substantially to a center of the upper surface of movable contact element 22 in left and right directions D102, and is fixed to contact-element holder 28. Adjuster 26 may have a shape other than a plate shape.

Yoke 27 is made of magnetic material, and has a cross section having substantially a U-shape opening upward viewing in left and right directions D102. Yoke 27 is disposed below a substantial center of movable contact element 22 so as to grasp the center of movable contact element 22 from front and back directions D103 perpendicular to upward and downward directions D101 and left and right directions D102. Positioning projection 271 having substantially a disk shape is formed at a substantial center of a lower surface of yoke 27.

As shown in FIG. 3, contact-element holder 28 includes a pair of retention parts 281. Each retention part 281 includes bottom part 282 and side part 283. Bottom part 282 and side part 283 are formed by bending a nonmagnetic material. The pair of retention parts 281 is formed unitarily with partition-wall component 24 while retention parts 281 are located away from each other in front and back directions D103. Partition-wall component 24 is provided between bottom part 282 and press-contact spring 23, and between side part 283 and press-contact spring 23. Hence, partition-wall component 24 electrically insulates bottom part 282 from press-contact spring 23.

A pair of bottom parts 282 together with adjuster 26 grasp movable contact element 22, yoke 27, and press-contact spring 23 in upward and downward directions D101. Hence, movable contact element 22 is urged by press-contact spring 23 in upward direction D101A out of upward and downward directions D101. The upper surface of movable contact element 22 contacting adjuster 26 restricts a movement of movable contact element 22 toward fixed contact 211. Side part 283 extends from an end of bottom part 282 in upward direction D101A. A pair of side parts 283 face each other in front and back directions D103. Movable contact element 22 and yoke 27 slide on side parts 283. Upon contacting adjuster 26, side part 283 causes the pair of side parts 283 to hold adjuster 26 in front and back directions D103. Each bottom part 282 has, e.g. a plate shape, but may have a shape other than the plate shape. Each side part 283 has, e.g. a plate shape, but may have a shape other than the plate shape.

Adjuster 26 provided above movable contact element 22, and yoke 27 provided below movable contact element 22 are made of magnetic material while contact-element holder 28 is made of nonmagnetic material. This configuration forms a magnetic flux flowing through adjuster 26 and yoke 27 about movable contact element 22 surrounding movable contact element 22 when fixed contact 211 contacts movable contact 221 to allow a current to flow through movable contact element 22. This magnetic flux generates a magnetic attractive force between adjuster 26 and yoke 27. This magnetic attractive force suppresses an electromagnetic repulsive force generated between fixed contact 211 and movable contact 221, and restrains a decrease of a contact pressure, a pressure generated when movable contact 221 contacts fixed contact 211.

Case 51 is made of a heat-resistant material and has a hollow box shape having a lower surface having opening 51C therein, as shown in FIG. 2. Two apertures 511 are provided in an upper surface of case 51, and arranged in left and right directions D102.

End 52A of connection body 52 is brazed with circumferential end 51D of opening 51C of case 51. Driver 3 includes yoke 35 including yoke plate 351. End 52B of connection body 52 is brazed with yoke plate 351 of yoke 35 of driver 3.

Partition-wall component 53 has lower surface 531 and projection 532. Insertion aperture 533 into which movable shaft 25 is inserted is formed in a substantial center of lower surface 531. Partition-wall component 53 is made of insulative material, such as ceramics or synthetic resin, and has a substantially a hollow rectangular parallelepiped shape having an upper surface having opening 53C therein. An upper end of a circumferential wall of partition-wall component 53 contacts an inner surface of a wall of case 51. An arc may be generated between fixed contact 211 and movable contact 221 at opening 51C of case 51. Partition-wall component 53 insulates the arc from a joint part where case 51 is joined to connection body 52.

Figure 4:
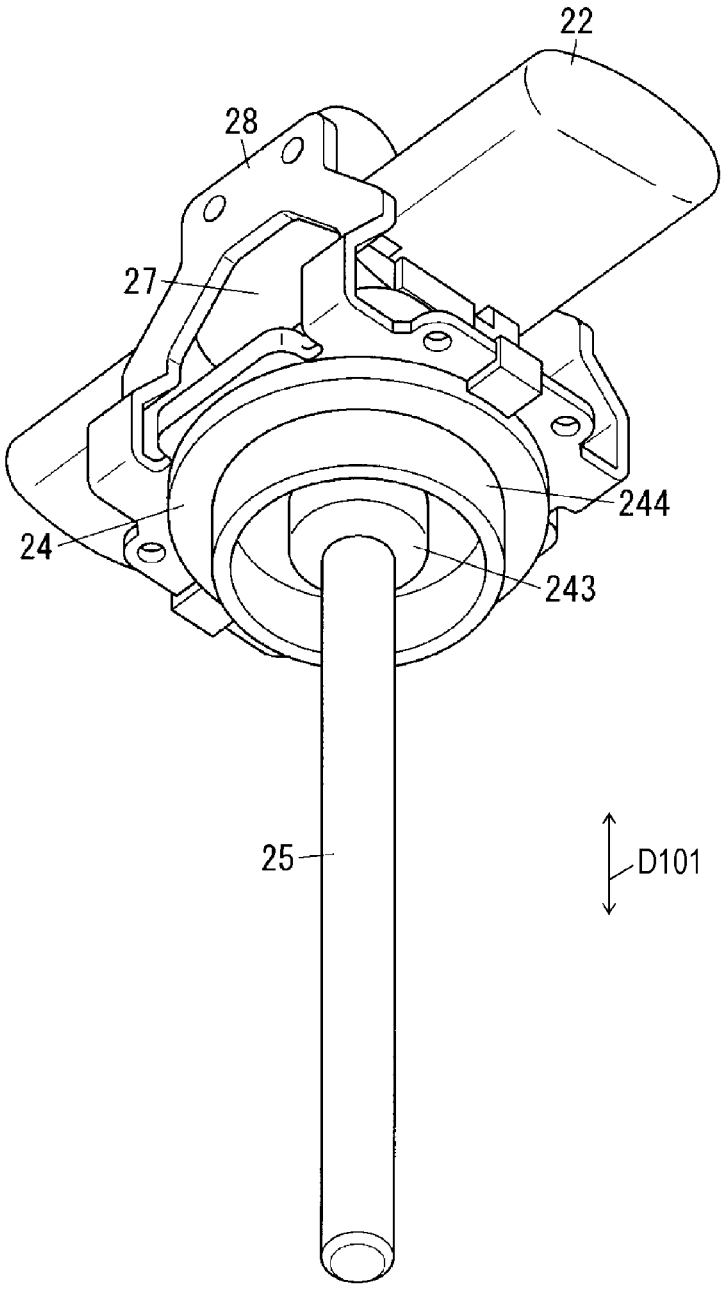
FIG. 4 is a perspective view of a main part of the electromagnetic relay according to Embodiment 1.

As shown in FIG. 2, partition-wall component 24 of contactor 2 according to Embodiment 1 is opposite to the pair of fixed contacts 211 with respect to movable contact element 22. FIG. 4 is a perspective view of a main part of electromagnetic relay 1. Partition-wall component 24 includes base 241, positioning projection 242, projection 243, and partition wall 244. Partition wall 244 is located around movable shaft 25 to surround movable shaft 25. In detail, partition wall 244 has, e.g. a cylindrical shape extending from base 241 toward partition-wall component 53 in axial direction D101 of movable shaft 25. Partition wall 244 according to Embodiment 1 moves synchronously with movable contact element 22 and movable shaft 25. Here, the term, "move synchronously", means that when a component moves, another component moves simultaneously or with a slight time delay. Partition wall 244 may move synchronously not with movable shaft 25, but with only movable contact element 22. Partition wall 244 may move synchronously not with movable contact element 22, but with only movable shaft 25.

In the conventional electromagnetic relay disclosed in Japanese Patent Laid-Open Publication No. 10-308152, the contact plate moves with respect the fixed lateral wall part, hence allowing foreign matter to enter the insertion aperture that is provided in an axis bushing and into which the movable shaft is inserted.

In contactor 2 and electromagnetic relay 1 according to Embodiment 1, partition wall 244 prevents, from, entering into insertion aperture 533, foreign matter produced by contact and separation between fixed contact 211 and movable contact element 22.

An operation of contactor 2 according to Embodiment 1 will be described below. First, when driver 3 displaces movable shaft 25 in upward direction D101A, partition-wall component 24 and contact-element holder 28 connected to movable shaft 25 are displaced in upward direction D101A, accordingly displacing movable contact element 22 in upward direction D101A. Then, movable contact element 22 contacts the pair of fixed contacts 211, thereby electrically connecting between the pair of fixed contacts 211.

Driver 3 will be detailed below.

Driver 3 is an electromagnet block drives and moves movable shaft 25 as to cause movable contact element 22 to contact the pair of fixed contacts 211 and to be separated from the pair of fixed contacts 211.

Driver 3 includes exciter coil 31, coil bobbin 32, fixed core 33, movable core 34, yoke 35, restoring spring 36, cylindrical component 37, and bushing 38. Driver 3 further includes a pair of coil terminals to which a pair of ends of exciter coil 31 are connected, respectively.

Coil bobbin 32 is made of resin material, and has substantially a cylindrical shape. Coil bobbin 32 includes cylindrical part 323, flange 321 provided at an upper end of cylindrical part 323, and flange 322 provided at a lower end of cylindrical part 323. Exciter coil 31 is wound on cylindrical part 323 between flanges 321 and 322. The inner diameter of the lower end of cylindrical part 323 is larger than that of the upper end of cylindrical part 323.

Each of a pair of ends of exciter coil 31 is connected to respective one of a pair of terminals provided on flange 321 of coil bobbin 32, and is connected to respective one of the pair of coil terminals via lead wires connected to the terminals. The coil terminals are made of conductive material, such as copper, and are connected to the lead wires with, e.g. solder.

Fixed core 33 is made of magnetic material, and has substantially a cylindrical shape. Fixed core 33 is disposed and fixed in coil bobbin 32. In detail, fixed core 33 is provided in cylindrical component 37 accommodated in cylindrical part 323 of coil bobbin 32.

Movable core 34 is made of magnetic material, and has substantially a cylindrical shape. Movable core 34 is disposed in coil bobbin 32 and faces fixed core 33 in axial direction D101. In detail, movable core 34 is provided in cylindrical component 37. Movable core 34 is fixed to movable shaft 25 and moves in upward and downward directions D101 in response to energization of exciter coil 31. In detail, when exciter coil 31 is energized, movable core 34 moves in upward direction D101A. When the energizing of exciter coil 31 stops, movable core 34 moves in downward direction D101B opposite to upward direction D101A.

Yoke 35 includes yoke plate 351, yoke plate 352, and a pair of yoke plates 353. Yoke plate 351 is provided at a side to the upper end of coil bobbin 32. Yoke plate 352 is provided at aside to the lower end of coil bobbin 32. The pair of yoke plates 353 extends from both ends of second yoke plate 352 in left and right directions D102 toward yoke plate 351. Yoke plate 351 has substantially a rectangular plate shape. Insertion aperture 354 is formed in a substantial center of an upper surface of yoke plate 351. An upper end of fixed core 33 is inserted into insertion aperture 354.

Restoring spring 36 is inserted into a bottom of aperture 331 of fixed core 33 and into an upper end of aperture 341 of movable core 34. Restoring spring 36 is compressed and inserted in between fixed core 33 and movable core 34, and elastically urges movable core 34 in downward direction D101B.

Cylindrical component 37 has a cylindrical shape having a bottom, and is accommodated in cylindrical part 323 of coil bobbin 32. Flange 371 is formed at an upper end of cylindrical component 37. Flange 371 is positioned between flange 321 of coil bobbin 32 and yoke plate 351. Movable core 34 is provided at a lower end of an inside of cylindrical part 372 of cylindrical component 37. Fixed core 33 is provided inside cylindrical part 372.

Bushing 38 is made of magnetic material, and has a cylindrical shape. Bushing 38 is fitted into a gap formed between a lower end of an inner circumferential surface of coil bobbin 32 and an outer circumferential surface of cylindrical component 37. Bushing 38 forms a magnetic circuit together with yoke plates 351 to 353, fixed core 33, and movable core 34.

Next, housing 4 will be detailed below.

Housing 4 is made of resin material, and has substantially a rectangular box shape. Housing 4 includes housing body 41 having a hollow box shape with an upper surface having an opening therein and cover 42 having a hollow box shape covering the opening of housing body 41.

Housing body 41 has side walls 414 in left and right directions D102. As shown in FIG. 1, a pair of projections 411 is provided at ends of side walls 414 in front direction D103A and back direction D103B opposite to each other along front and back directions D103. The pair of projections 411 has insertion apertures therein used for fixing electromagnetic relay 1 to a mounting surface with screws. As shown in FIG. 2, stepped part 412 is formed on a circumferential end of the opening close to an upper end of housing body 41. An inner diameter of the upper end of housing body 41 is larger than that of the lower end of housing body 41.

Cover 42 has a hollow box with a lower surface having an opening therein. Partition 422 is provided on upper surface 421 of cover 42, and separates upper surface 421 into two parts arranged in left and right directions D102. A pair of insertion apertures 423 through which fixed terminals 21 are inserted, respectively, are provided in two parts of upper surface 421 separated by partition 422.

When contactor 2 and driver 3 are accommodated in housing 4, lower cushion rubber 43 is provided between yoke plate 352 of yoke 35 and lower surface 413 of housing body 41. Upper cushion rubber 44 is provided between case 51 and cover 42. Upper cushion rubber 44 has insertion aperture 441 therein through which fixed terminal 21 is inserted.

In electromagnetic relay 1, restoring spring 36 urges movable core 34 to cause movable core 34 to slide in downward direction D101B, and causes movable shaft 25 to move in downward direction D101B accordingly. Resultantly, upon being pressed downward D101B by adjuster 26, movable contact element 22 moves in downward direction D101B together with adjuster 26. For this purpose, movable contact 221 is initially spaced from fixed contact 211.

When exciter coil 31 is energized, movable core 34 is attracted by fixed core 33 and slides in upward direction D101A, accordingly moving movable shaft 25 connected to movable core 34 synchronously in upward direction D101A. Resultantly, partition-wall component 24 (contact-element holder 28) connected to movable shaft 25 moves toward fixed contact 211, thereby causes movable contact element 22 to move in upward direction D101A. Then, movable contact 221 contacts fixed contact 211 to electrically connect between movable contact 221 and fixed contact 211.

When the energizing of exciter coil 31 stops, restoring spring 36 urges movable core 34 to cause movable core 34 to slide in downward direction D101B, accordingly moving movable shaft 25 in downward direction D101B. Resultantly, partition-wall component 24 (contact-element holder 28) moves in downward direction D101B, and causes movable contact element 22 to move in downward direction D101B, hence causing fixed contact 211 to move away from movable contact 221.

In contactor 2 of electromagnetic relay 1 according to Embodiment 1, movable contacts 221 is parts of movable contact element 22 and are formed unitarily with movable contact element 22. Movable contacts 221 may be provided separately from movable contact element 22. In this case, movement of movable shaft 25 causes movable contact 221 provided separately from movable contact element 22 to move unitarily with movable contact element 22 as well, and cause movable contact 221 to contact fixed contact 211 and be separated from fixed contact 211.

In contactor 2 according to Embodiment 1, partition wall 244 is provided near a position (a contact part) where movable contact element 22 contacts the pair of fixed contacts 211 and is separated from the pair of fixed contacts 211, that is where foreign matter is produced. This configuration efficiently reduces the entry of foreign matter into insertion aperture 533 of movable shaft while having a simple structure. Hence, the configuration reduces the entry of foreign matter into driver 3 through insertion aperture 533.

Exemplary embodiment 2

Figure 5:
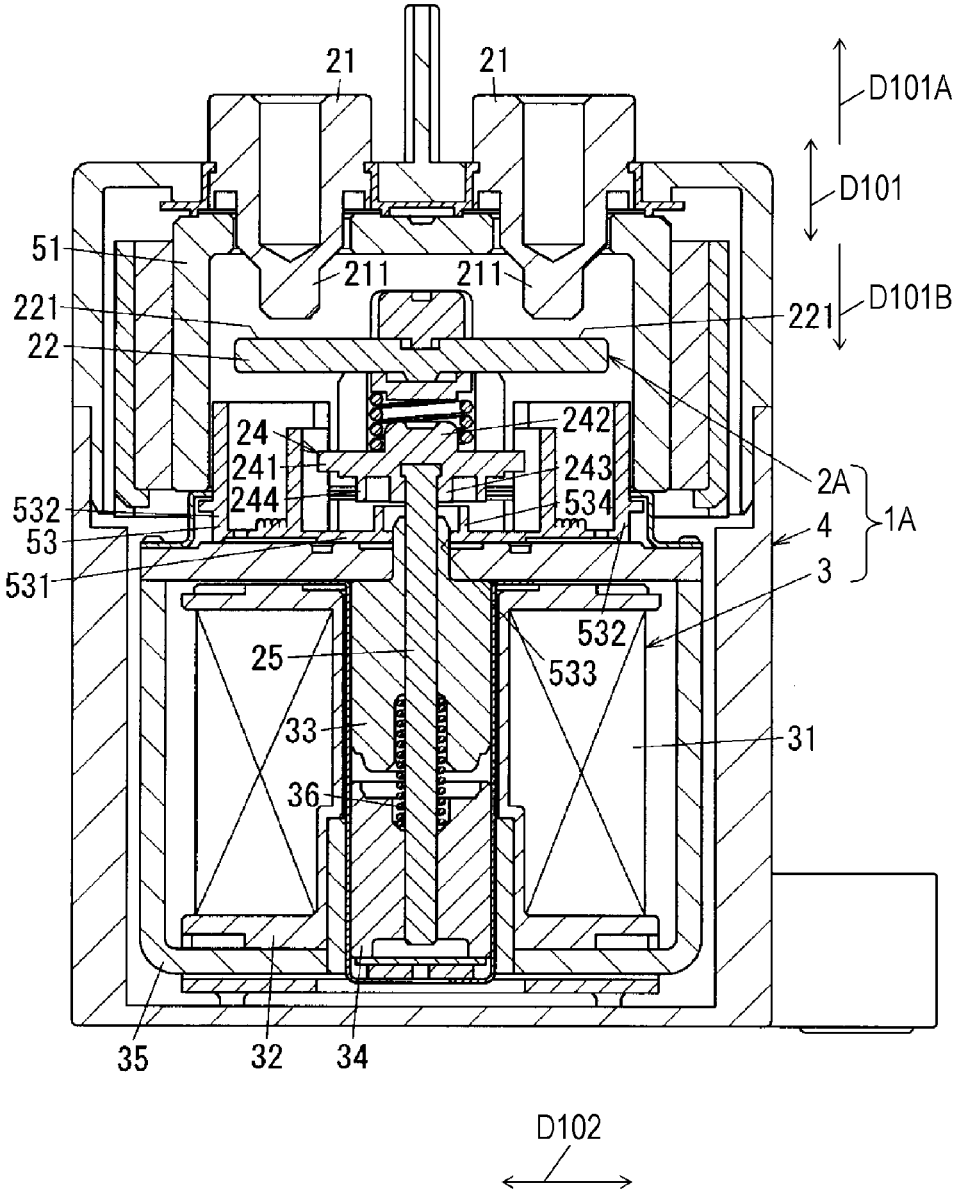
FIG. 5 is a sectional view of an electromagnetic relay according to Exemplary Embodiment 2.

FIG. 5 is a sectional view of electromagnetic relay 1A according to Exemplary Embodiment 2. In FIG. 5, components identical to those of electromagnetic relay 1 according to Embodiment shown in FIGS. 1 to 4 are debited by the same reference numerals. Electromagnetic relay 1A includes contactor 2A instead of contactor 2 of electromagnetic relay 1 according to Embodiment 1. As shown in FIG. 5, contactor 2A according to Embodiment 2 includes partition wall 534 on partition-wall component 53.

Partition-wall component 53 according to Embodiment 2 includes partition wall 534 provided around insertion aperture 533 as to surround insertion aperture 533 into which movable shaft 25 is inserted. In other words, partition-wall component 53 has lower surface 531, projection 532, and partition wall 534. Partition wall 534 extends from lower surface 531 toward partition-wall component 24 in axial direction D101 of movable shaft 25. Partition-wall component 53 faces partition-wall component 24 in axial direction D101 (upward and downward directions D101) of movable shaft 25.

In contactor 2A according to Embodiment 2, partition walls 244 and 534 are provided near a position (a contact part) where movable contact element 22 contacts fixed contacts 211 and is separated from fixed contacts 211, that is, where foreign matter is produced. This configuration efficiently reduces the entry of foreign matter into the insertion aperture of movable shaft 25 while having a simple structure.

Exemplary embodiment 3

Figure 6:
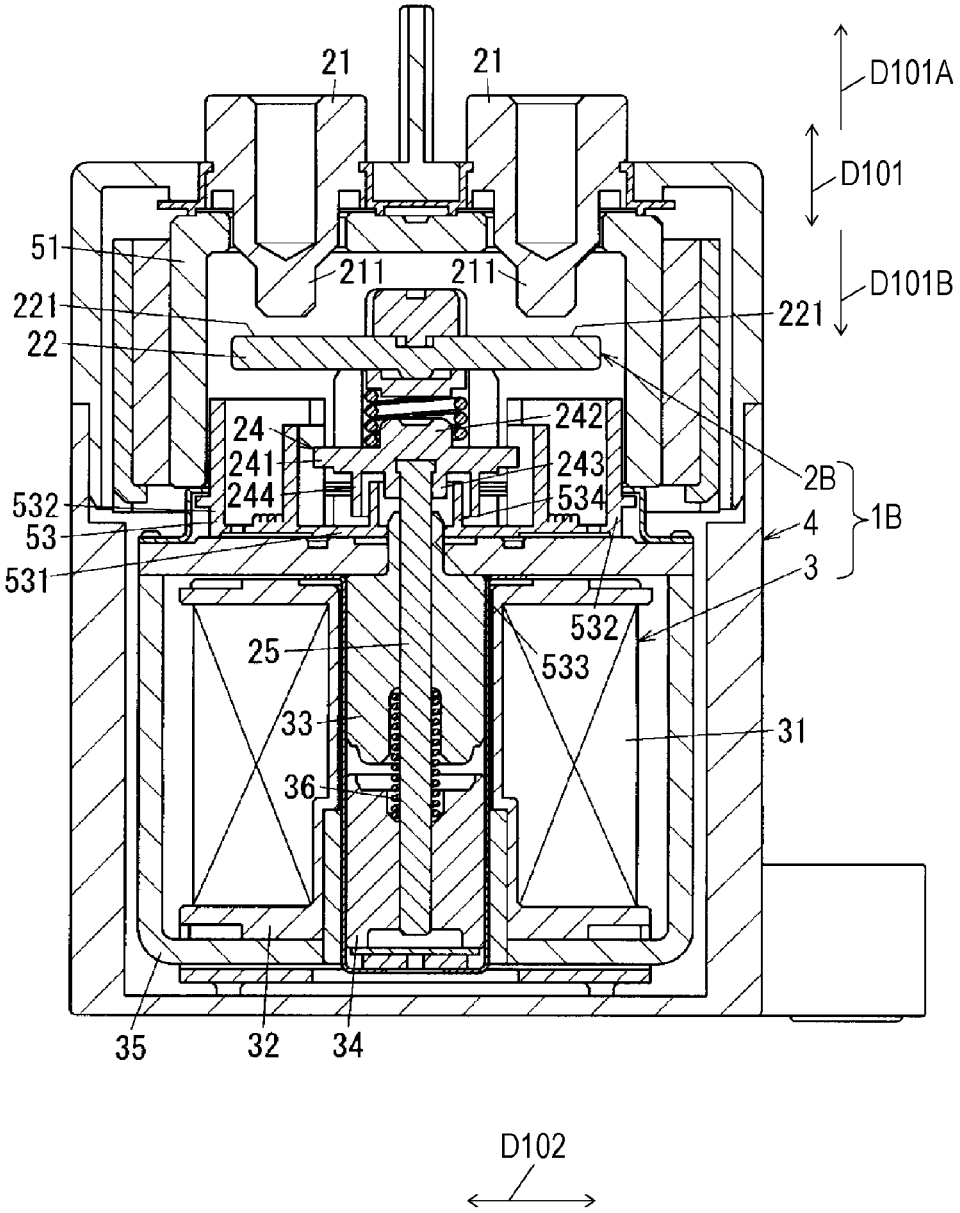
FIG. 6 is a sectional view of an electromagnetic relay according to Exemplary Embodiment 3.

FIG. 6 is a sectional view of electromagnetic relay 1B according to Exemplary Embodiment 3. In FIG. 5, components identical to those of electromagnetic relay 1A according to Embodiment 1 shown in FIG. 2 are denoted by the same reference numerals. Electromagnetic relay 1B includes contactor 2B instead of contactor 2A of electromagnetic relay 1A according to Embodiment 2. As shown in FIG. 6, in contactor 2B according to Embodiment 3, partition wall 244 of partition-wall component 24 overlaps partition-wall 534 of partition-wall component 53.

Figure 7:
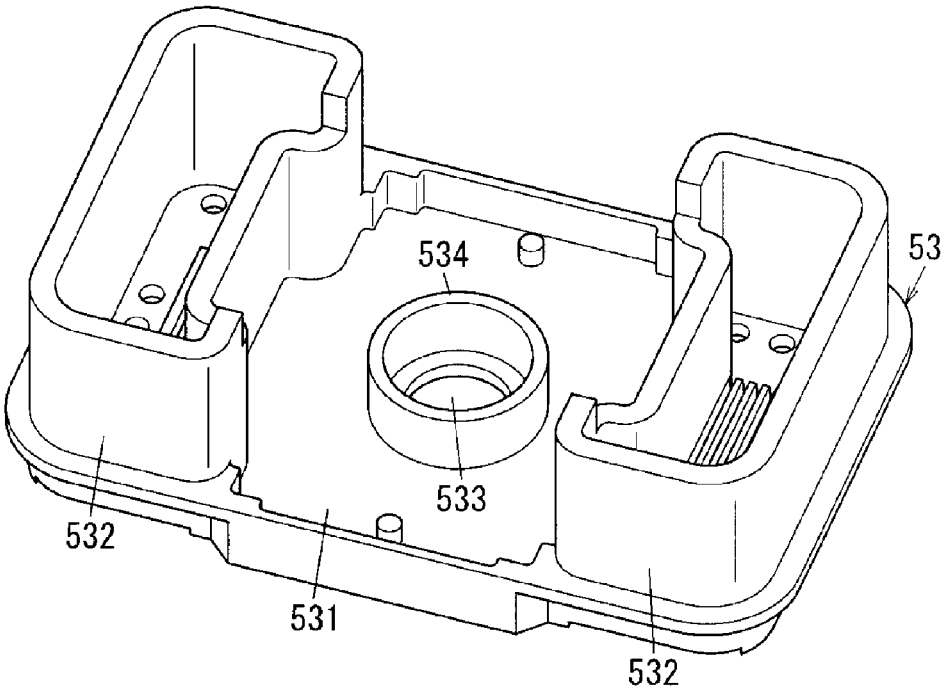
FIG. 7 is a perspective view of a main part of the electromagnetic relay according to Embodiment 3.

Partition wall 244 of partition-wall component 24 overlaps partition wall 534 of partition-wall component 53 according to Embodiment 3 in a direction perpendicular to axial direction D101 of movable shaft 25. FIG. 7 is a perspective view of a main part of electromagnetic relay 1B. In detailed, partition-wall component 53 has lower surface 531, and includes projection 532 and partition wall 534, as shown in FIG. 7. Partition wall 534 extends from lower surface 531 toward partition-wall component 24 in axial direction D101 of movable shaft 25. Partition walls 244 and 534 overlap each other in left and right directions D102 and in front and back directions D103 which are perpendicular to axial direction D101 of movable shaft 25.

In contactor 2B according to Embodiment 3, partition wall 244 of partition-wall component 24 overlaps partition wall 534 of partition-wall component 53 to increase a moving path of foreign matter, thereby reducing the entry of the foreign matter.

Exemplary embodiment 4

Figure 8:
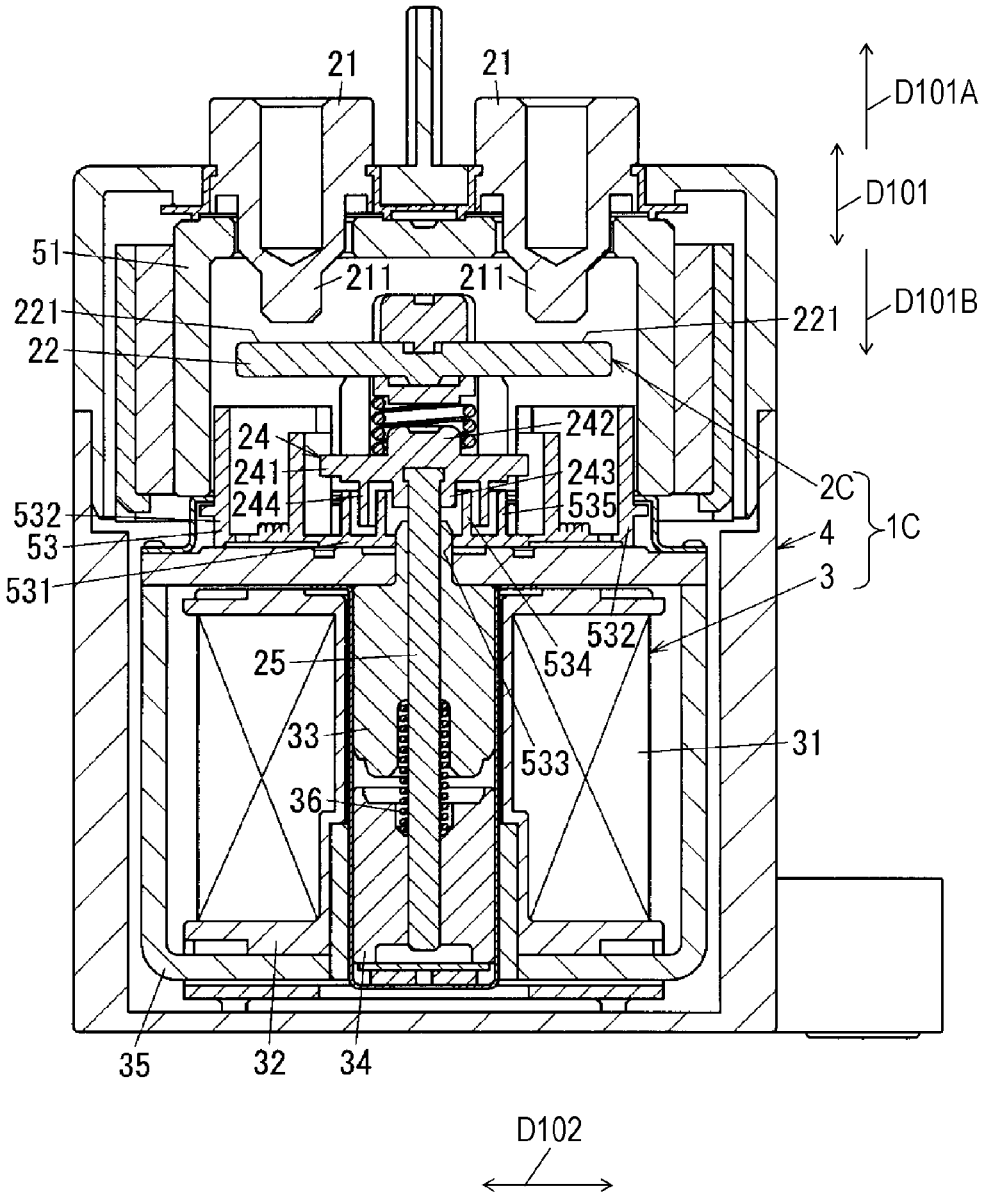
FIG. 8 is a sectional view of an electromagnetic relay according to Exemplary Embodiment 4.
Figure 9:
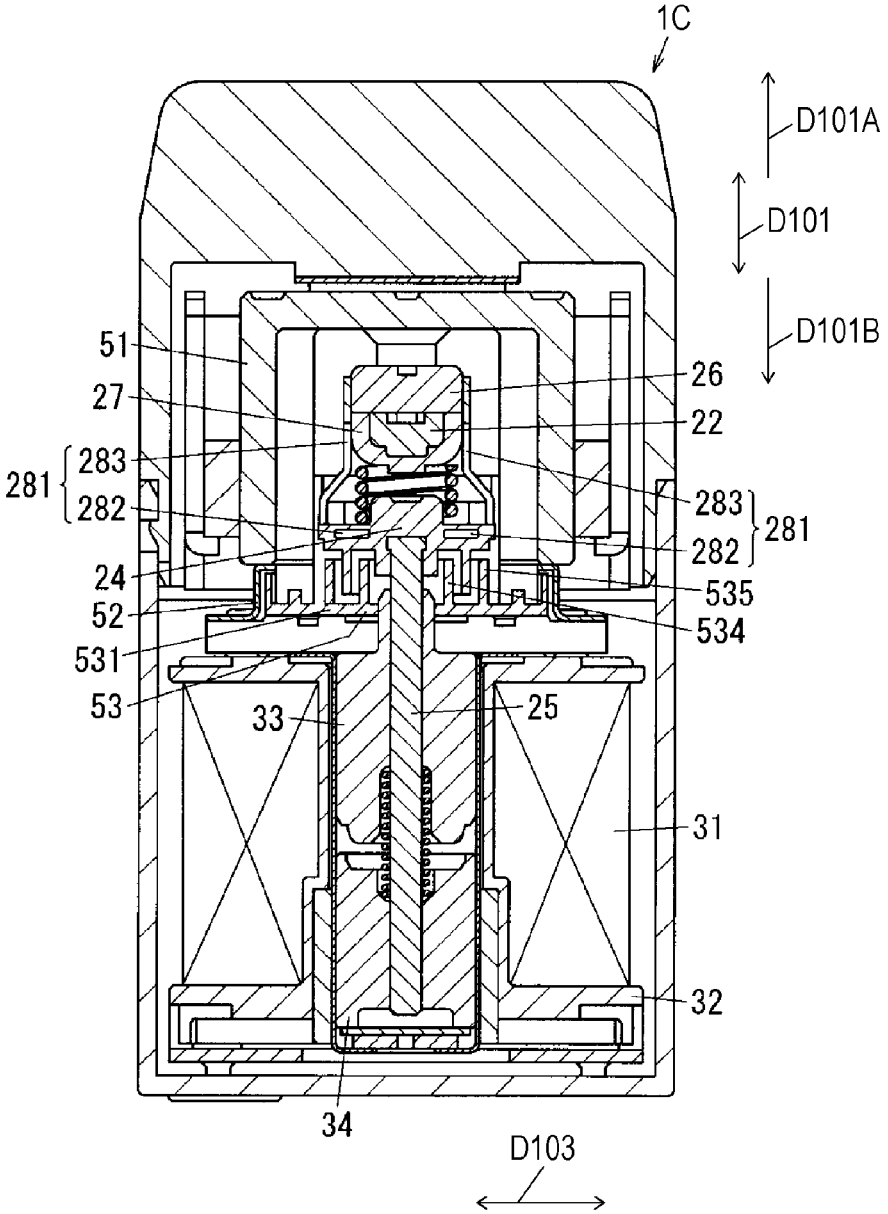
FIG. 9 is an external view of a main part of the electromagnetic relay according to the fourth embodiment.

FIGS. 8 and 9 are sectional views of electromagnetic relay 1C according to Exemplary Embodiment 4. In FIGS. 8 and 9, components identical to those of electromagnetic relay 1B according to Embodiment 3 shown in FIG. 6 and electromagnetic relay 1 according to Embodiment 1 shown in FIGS. 1 to 4 are denoted by the same reference numerals. Electromagnetic relay 1C includes contactor 2C instead of contactor 2 of electromagnetic relay 1 according to Embodiment 1. In contactor 2C according to Embodiment 4, partition walls 244, 534, and 535 overlap with one another, as shown in FIGS. 8 and 9.

Figure 10A:
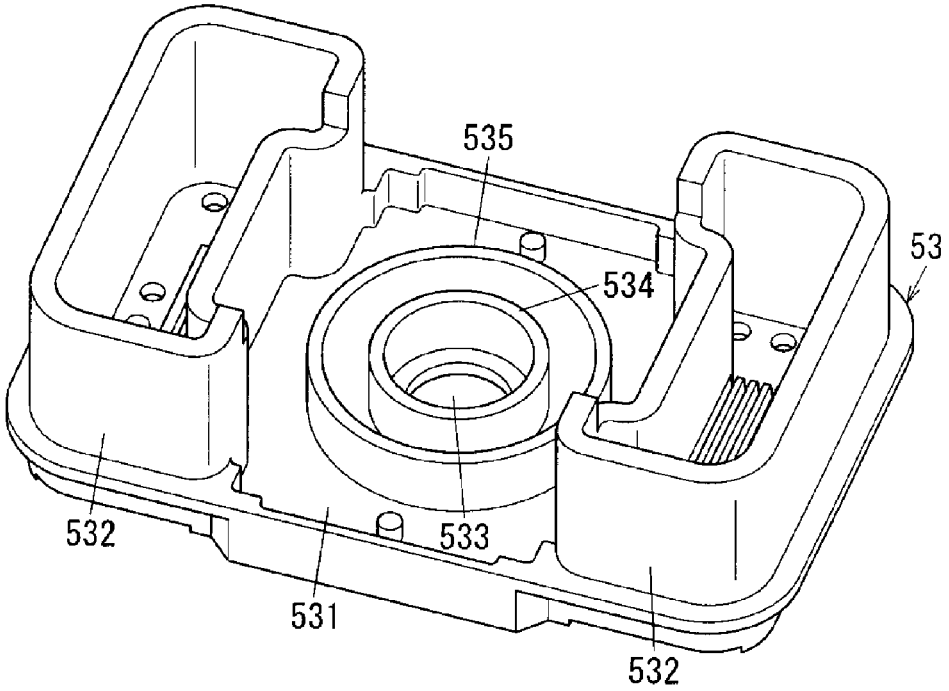
FIG. 10A is an external view of the main part of the electromagnetic relay according to Embodiment 4.

Partition walls 534 and 535 of partition-wall component 53 according to Embodiment 4 are provided around movable shaft 25 as to concentrically surround movable shaft 25. FIG. 10A is a perspective view of a main part of electromagnetic relay 1C. As shown in FIG. 10A, partition-wall component 53 has lower surface 531, and includes projection 532 and two partition walls 534 and 535. According to Embodiment 4, partition walls 244, 534, and 535 alternately overlap one another in a direction perpendicular to axial direction D101 of movable shaft 25.

In contactor 2C according to Embodiment 1, partition wall 244 of partition-wall component 24 and partition walls 534 and 535 of partition-wall component 53 increase a moving path of foreign matter like a labyrinth, hence reducing the entry of the foreign matter.

Instead of the partition wall of partition-wall component 53, plural partition walls of partition-wall component 24 may be provided around movable shaft 25 as to concentrically surround movable shaft 25. Alternatively, plural partition walls of partition-wall components 24 and 53 may be provided around movable shaft 25 as to concentrically surround movable shaft 25.

Figure 10B:
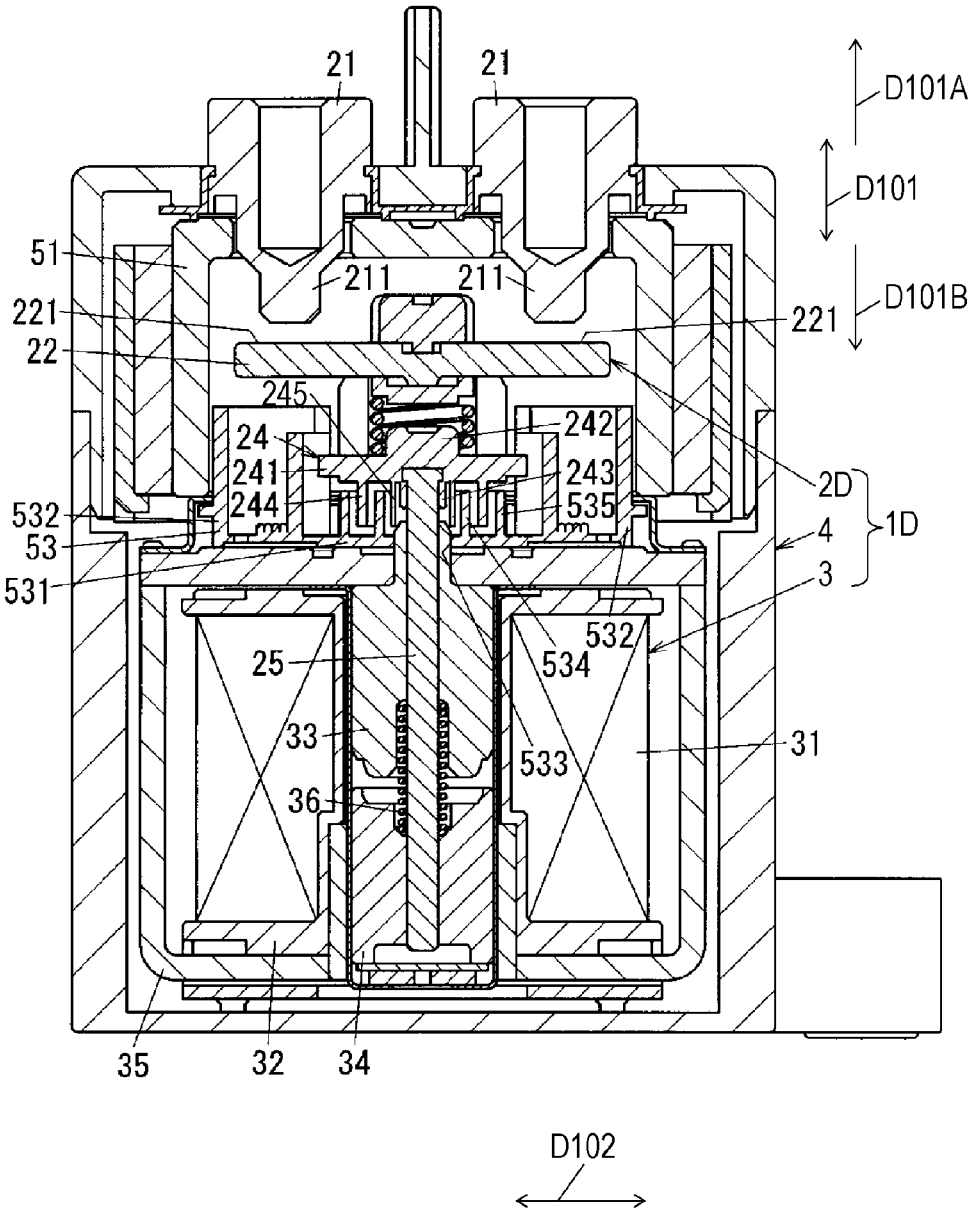
FIG. 10B is a sectional view of a main part of another electromagnetic relay according to Embodiment 4.

FIG. 10B is a sectional view of another electromagnetic relay 1D according to Embodiment 4. In FIG. 10B, components identical to those of electromagnetic relay 1C shown in FIG. 8 are denoted by the same reference numerals. Electromagnetic relay 1D includes contactor 2D instead of contactor 2C of electromagnetic relay 1C. As shown in FIG. 10B, partition-wall component 24 of electromagnetic relay 1D includes two partition walls 244 and 245 projecting from base 241 in downward direction D101B. Partition walls 244 and 245 alternately overlaps partition walls 534 and 535 in a direction perpendicular to axial direction D101 of movable shaft 25. In detail, partition wall 534 is positioned between partition walls 244 and 245 in a direction perpendicular to axial direction D101 while partition wall 244 is positioned between partition walls 534 and 535 in the direction perpendicular to axial direction D101.

In contactor 2D of electromagnetic relay 1D, partition walls 244 and 245 of partition-wall component 24 and partition walls 534 and 535 of partition-wall component 53 increase a moving path of foreign matter like a labyrinth, thereby reducing the entry of the foreign matter.

As described above, partition-wall component 24 of electromagnetic relay 1D further includes partition wall 245 that is provided around movable shaft 25. Partition wall 245 moves synchronously with at least one of movable contact element 22 and movable shaft 25, and is provided around movable shaft 25 concentrically with partition wall 244. Partition walls 244, 245, and 534 alternately overlap one another such that partition wall 534 is positioned between partition walls 244 and 245 in a direction perpendicular to axial direction D101.

Partition-wall component 53 further includes partition wall 535 provided around insertion aperture 533 and provided concentrically with partition wall 534. Partition walls 244, 245, 534, and 535 alternately overlap one another such that wall 534 is positioned between partition walls 244 and 245 in a direction perpendicular to axial direction D101 and that partition wall 244 is positioned between partition walls 534 and 535 in the direction perpendicular to axial direction D101.

Exemplary embodiment 5

Figure 11:
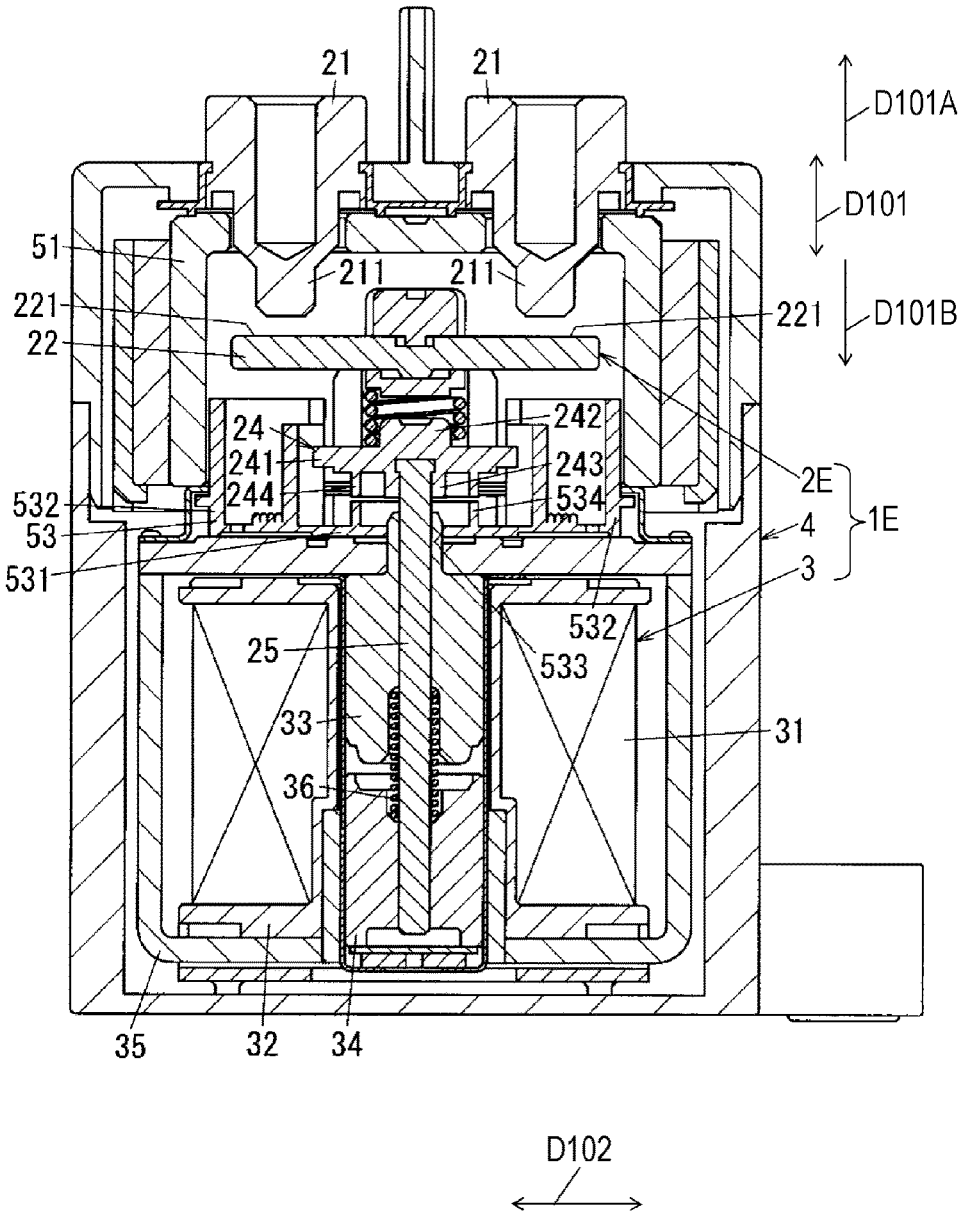
FIG. 11 is a sectional view of an electromagnetic relay according to Exemplary Embodiment 5.

FIG. 11 is a sectional view of electromagnetic relay 1E according to Exemplary Embodiment 5. In FIG. 11, components identical to those of electromagnetic relay 1A according to Embodiment 2 shown in FIG. 5 and electromagnetic relay 1 according to Embodiment 1 shown in FIGS. 1 to 4 are denoted by the same reference numerals. Electromagnetic relay 1E includes contactor 2E instead of contactor 2A of electromagnetic relay 1A according to Embodiment 2. In contactor 2E according to Embodiment 5, end of corresponding partition wall 244 faces end of corresponding partition wall 534, as shown in FIG. 11.

In contactor 2E according to Embodiment 5, an end of partition wall 244 of partition-wall component 24 faces an end of partition wall 534 of partition-wall component 53 in axial direction D101 of movable shaft 25. That is, partition walls 244 and 534 have cylindrical shapes with the same radius.

In contactor 2E according to Embodiment 5, partition wall 244 of partition-wall component 24 contacts partition wall 534 of partition-wall component 53 in axial direction D101 of movable shaft 25, thereby providing the contactor with a small size.

Exemplary embodiment 6

Figure 12:
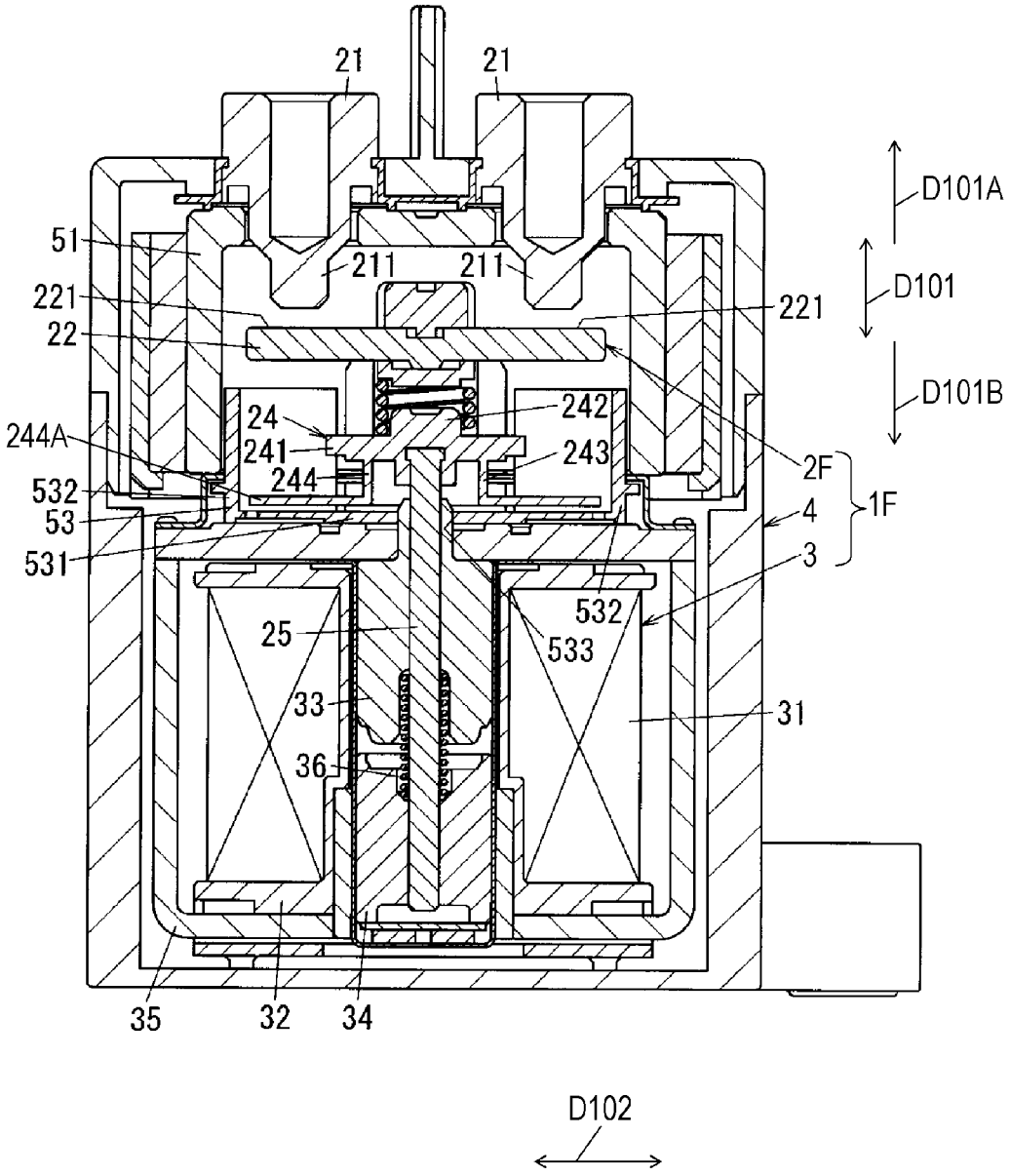
FIG. 12 is a sectional view of an electromagnetic relay according to Exemplary Embodiment 6.

FIG. 12 is a sectional view of electromagnetic relay 1F according to Exemplary Embodiment 6. In FIG. 12, components identical to those of electromagnetic relay 1 according to Embodiment 1 shown in FIGS. 1 to 4 are denoted by the same reference numerals. Electromagnetic relay 1F includes contactor 2F instead of contactor 2 of electromagnetic relay 1 according to Embodiment 1. As shown in FIG. 12, contactor 2F includes partition wall 244 as to isolate the upper part of partition-wall component 24 from the lower part of partition-wall component 24.

Partition-wall component 24 according to Embodiment 6 further includes extension 244A extending from a lower end of partition wall 244 in a direction crossing axial direction D101 of movable shaft 25. In other words, partition wall 244 extends from base 241 in axial direction D101 of movable shaft 25 while extension 244A extends from the lower end of partition wall 244 in a direction crossing axial direction D101.

Contactor 2F according to Embodiment 6 decreases a gap between partition wall 244 (extension 244A) and projection 532 positioned in a circumferential direction about movable shaft 25. This configuration increases a moving path of foreign matter, and reduces the entry of the foreign matter into insertion aperture 533 accordingly.

In the embodiments, terms, such as "upper surface", "upper end", "lower end", "upward and downward directions", and "left and right directions", indicating directions indicate relative directions depending only on relative positional relationships between components of the contactor and the electromagnetic relay, and do not indicate absolute directions, such as a vertical direction.

What is claimed is:

1. A contactor comprising:

a pair of fixed contacts;

a movable contact configured to come into contact with and be separated from the pair of fixed contacts;

a movable shaft configured to move in an axial direction so as to cause the movable contact to contact the pair of fixed contacts and to be separated from the pair of fixed contacts; and a first partition-wall component disposed opposite to the pair of fixed contacts with respect to the movable contact, wherein the first partition-wall component includes a first base and a first partition wall extending from the first base in the axial direction, and wherein the first partition wall is provided around the movable shaft and entirely surrounds the movable shaft along a circumferential direction with respect to a longitudinal axis of the movable shaft, the first partition wall being configured to move synchronously with at least one of the movable contact and the movable shaft.

2. The contactor of claim 1, further comprising a second partition-wall component having therein an insertion aperture into which the movable shaft extends, the second partition-wall component facing the first partition-wall component in the axial direction.

3. The contactor of claim 2, wherein the second partition-wall component includes a second partition wall provided around the insertion aperture.

4. The contactor of claim 3, wherein the first partition wall overlaps the second partition wall in a direction perpendicular to the axial direction.

5. The contactor of claim 4, wherein the first partition-wall component further includes a third partition wall provided around the movable shaft concentrically with the first partition wall, the third partition wall moving synchronously with at least one of the movable contact and the movable shaft, and wherein the first partition wall, the second partition wall, and the third partition wall alternately overlap one another in the direction perpendicular to the axial direction such that the second partition wall is located between the first partition wall and the third partition wall in the direction perpendicular to the axial direction.

6. The contactor of claim 5, wherein the second partition-wall component further includes a fourth partition wall provided around the insertion aperture concentrically with the second partition wall, and wherein the first partition wall, the second partition wall, the third partition wall, and the fourth partition wall alternately overlap one another in the direction perpendicular to the axial direction such that the second partition wall is located between the first partition wall and the third partition wall and that the third partition wall is located between the second partition wall and the fourth partition wall in the direction perpendicular to the axial direction.

7. The contactor of claim 4, wherein the second partition-wall component further includes a third partition wall provided around the insertion aperture concentrically with the second partition wall, and wherein the first partition wall, the second partition wall, and the third partition wall alternately overlap one another in the direction perpendicular to the axial direction such that the first partition wall is located between the second partition wall and the third partition wall in the direction perpendicular to the axial direction.

8. The contactor of claim 3, wherein an end of the first partition wall faces an end of the second partition wall in the axial direction.

9. The contactor of claim 1, wherein the first partition wall includes an extension extending in a direction crossing the axial direction.

10. An electromagnetic relay comprising:

the contactor of claim 1; and a driver configured to drive the movable shaft as to allow the contact element to contact the pair of fixed contacts and to be separated from the pair of fixed contacts.

11. The contactor of claim 3, wherein the second partition-wall component further includes a second base having the insertion aperture therein, and wherein the second partition wall is provided around the insertion aperture and extends from the second base.

12. The contactor of claim 11, wherein the second partition wall entirely surrounds the movable shaft along a circumferential direction about the movable shaft.

13. The contactor of claim 12, wherein the second partition wall entirely surrounds the movable shaft and the first partition wall along a circumferential direction about the movable shaft.

14. The contactor of claim 4, wherein the first partition wall of the first partition-wall component extends from the first base toward the second partition-wall component, and wherein the second partition wall of the second partition-wall component extends from the second base toward the first partition-wall component.

15. The contactor of claim 1, wherein the first base of the first partition-wall component is connected to the movable shaft.

16. The contactor of claim 1, wherein the movable shaft extends in the axial direction, a dimension of the movable shaft in the axial direction being greater than a dimension of the movable shaft in a direction transverse to the axial direction.

17. The contactor according to claim 1, wherein the circumferential direction is orthogonal to the axial direction.

18. The contactor according to claim 1, wherein the first base extends in the circumferential direction with respect to the movable shaft.

* * * * *